US009583077B2

(12) United States Patent
Cockcroft

(10) Patent No.: US 9,583,077 B2
(45) Date of Patent: Feb. 28, 2017

(54) ELECTRIC STRINGED INSTRUMENT AMPLIFIER

(71) Applicant: Powers James Cockcroft, Ghent, NY (US)

(72) Inventor: Powers James Cockcroft, Ghent, NY (US)

( * ) Notice: Subject to any disclaimer, the term of this patent is extended or adjusted under 35 U.S.C. 154(b) by 0 days.

(21) Appl. No.: 15/049,559

(22) Filed: Feb. 22, 2016

(65) Prior Publication Data

US 2016/0247489 A1 Aug. 25, 2016

Related U.S. Application Data

(60) Provisional application No. 62/176,618, filed on Feb. 23, 2015, provisional application No. 62/179,590, filed on May 13, 2015.

(51) Int. Cl.
*G10D 3/02* (2006.01)
*G10D 1/08* (2006.01)

(52) U.S. Cl.
CPC ..... *G10D 3/02* (2013.01); *G10D 1/085* (2013.01)

(58) Field of Classification Search
CPC .. G10D 3/06; G10D 1/08; G10D 3/02; G10D 1/085; G10D 3/00; G10D 1/00; G10D 9/00; G10H 1/0091
USPC ..... 84/267, 290, 293, 294
See application file for complete search history.

(56) References Cited

U.S. PATENT DOCUMENTS

| | | | | |
|---|---|---|---|---|
| 7,151,216 | B1 | 12/2006 | Hutmacher | |
| 7,671,268 | B2 | 3/2010 | Nicoll | |
| 2016/0093279 | A1* | 3/2016 | Klemarewski | G10H 3/186 84/726 |

* cited by examiner

*Primary Examiner* — Kimberly Lockett
(74) *Attorney, Agent, or Firm* — Sorell Lenna & Schmidt, LLP

(57) ABSTRACT

An electric stringed instrument amplifier includes a housing including an inner surface that defines a cavity configured for disposal of at least a portion of a headstock of an electric stringed instrument that emits sound. A tension member extends from the housing and is engageable with the headstock. Systems and methods are provided.

21 Claims, 5 Drawing Sheets

ELECTRIC STRINGED INSTRUMENT AMPLIFIER

CROSS-REFERENCE TO RELATED APPLICATIONS

This application claims the benefits of U.S. Provisional Patent Application No. 62/176,618 filed Feb. 23, 2015 and U.S. Provisional Patent Application No. 62/179,590 filed May 13, 2015, the contents of each of these applications being hereby incorporated in their respective entireties by reference.

TECHNICAL FIELD

The present disclosure generally relates to musical instruments and accessories, and more particularly to devices, systems and methods for acoustic amplification of electric stringed instruments.

BACKGROUND

Amplification systems for electric musical instruments, such as, for example, electric guitars are known and may include electronic amplifiers and external speakers connected thereto. In some cases, an electric guitar includes a magnetic pickup that electrically detects a vibration of strings and amplifies the same with sound through external speakers. Acoustic-electric guitars are also known that can be electrically wired with a pickup for similar use with an electronic amplifier and external speakers.

The components of such amplification systems can be bulky devices driven by an AC power source and require connecting cables extending to both the guitar and the external speakers. Due to space and power requirements, these types of amplification systems can have a limited utility. In some cases, musicians employ portable battery-operated amplification systems to practice playing electric instruments. For example, a portable system may include a portable amplifier connected to an electric guitar by a loose connection cable. Such portable amplifier systems, however, can be clumsy and awkward to use due to the loose hanging cables and difficulty in setting adjustment. This disclosure describes an improvement over these prior technologies.

SUMMARY

In one embodiment, an electric stringed instrument amplifier is provided. The electric stringed instrument amplifier includes a housing having an inner surface that defines a cavity configured for disposal of at least a portion of a headstock of an electric stringed instrument that emits sound. A tension member extends from the housing and is engageable with the headstock. In some embodiments, systems and methods are provided.

BRIEF DESCRIPTION OF THE DRAWINGS

The present disclosure will become more readily apparent from the specific description accompanied by the following drawings, in which.

DETAILED DESCRIPTION

Figure 1:
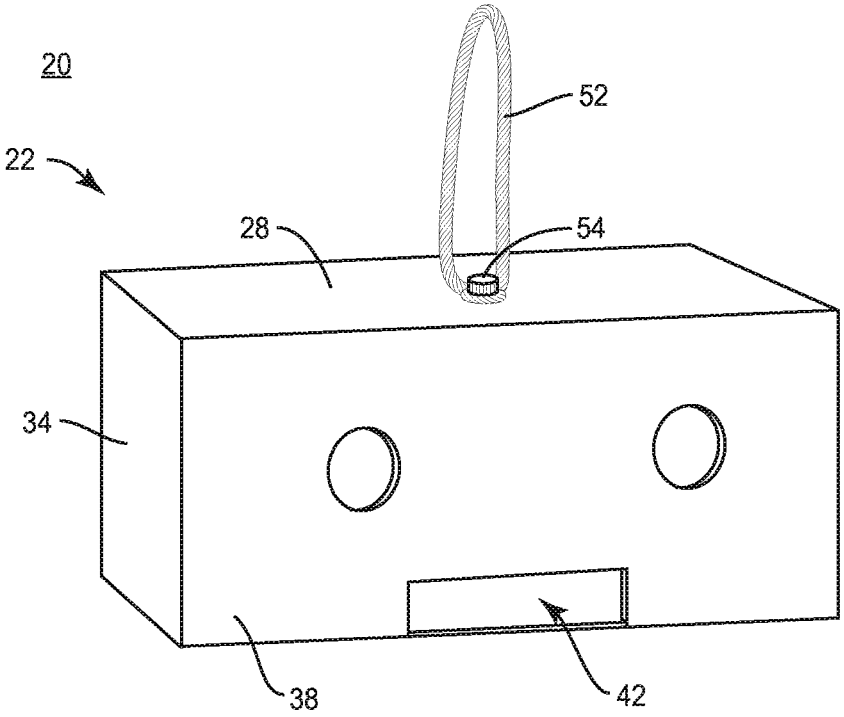
FIG. 1 is a perspective view of components of one embodiment of an amplification system in accordance with the principles of the present disclosure.

The exemplary embodiments of an acoustic amplification system and related methods of use disclosed are discussed in terms of musical instruments and accessories, and more particularly in terms of devices, systems and methods for acoustic amplification of electric stringed instruments. In some embodiments, the present amplification system includes a device, such as, for example, an acoustic amplifier that increases strength and/or intensity, makes louder, larger and/or greater, enlarges, extends and/or expands, the signal, vibration and/or sound of an electric stringed instrument. In some embodiments, the present system comprises a device that acoustically amplifies the sound from vibration of the strings of an electric guitar. In some embodiments, the present system comprises a device that acoustically amplifies the sound from vibration of the strings of an electric guitar non-electronically.

In some embodiments, the present system comprises a device that is connected, attached and/or mounted onto a headstock of an electric stringed instrument, such as, for example, an electric guitar, electric bass, or other electric stringed instrument. In some embodiments, the size and shape of the amplification device is selected based on the number, size and placement of the strings of the electric guitar.

In some embodiments, the device acoustically amplifies sound emitted from vibrations of strings of an electric stringed instrument, for example, when manually struck by a musical instrument user. In some embodiments, the device is connected, attached and/or mounted to the electric stringed instrument via tension to maintain connection on the instrument and to improve sound transmittance. In some embodiments, the device is connected, attached and/or mounted to the electric stringed instrument in one or a plurality of alternate positions. In some embodiments, the device can be employed with an electric stringed instrument for performance, demonstration, instruction and/or practice without the need for electrical amplifiers, wires, or electric power. In some embodiments, the device increases strength and/or intensity, makes louder, larger and/or greater, enlarges, extends and/or expands, the signal, vibration and/or sound of an electric stringed instrument while playing the instrument unplugged and/or without the need for electrical amplifiers, wires, or electric power.

In some embodiments, the present system comprises an amplification device that increases strength and/or intensity, makes louder, larger and/or greater, enlarges, extends and/or expands, the signal, vibration and/or sound of an electric stringed instrument acoustically by enhancing transmission of vibration of the strings of the electric stringed instrument without electronic amplification. In some embodiments, the amplification device comprises a sound box. In some embodiments, the amplification device comprises one or a plurality of sound boards. In some embodiments, the amplification device includes a sound box and/or sound board that receives sound waves from the strings of the electric stringed instrument, which resonate through the sound box and/or sound board to increase strength and/or intensity, make louder, larger and/or greater, enlarge, extend and/or expand, the signal, vibration and/or sound of the strings. In some embodiments, the strings can generate sound waves and/or vibrate at one or a plurality of frequencies and/or create one or a plurality of harmonics at various frequencies. In some embodiments, the amplification device includes a sound box and/or sound board that increases a surface vibrating area of the strings. In some embodiments, the amplification device includes a sound box and/or sound board that increases a surface vibrating area of the strings via mechanical impedance to emit sound. In some embodiments, the amplification device includes a hollow body.

In some embodiments, the present system includes a housing, such as, for example, a box. In some embodiments, the housing can be fabricated from one or a plurality of components. In some embodiments, the components are made from material that is approximately 5/32 inches thick. In some embodiments, the material includes, but is not limited to various woods, metals and/or plastics. In some embodiments, the housing can be made from various manufacturing processes, including, but not limited to injection molding or three dimensional printing.

In some embodiments, the housing includes a top panel. In some embodiments, the top panel includes an outer surface that defines a hole for mounting a screw to fix a plastic eye loop to the top panel. In some embodiments, the plastic eye loop is configured to hold a flexible elastic member, such as an elastic band. In some embodiments, the box includes a front panel, side panels, and a bottom panel. In some embodiments, one or more of the panels may have the same, similar or identical configuration and/or dimension. For example, the housing can include identical side panels and/or identical front and bottom panels. In some embodiments, the front panel includes an outer surface that defines a plurality of spaced apart openings. In some embodiments, the plurality of spaced apart openings includes a first opening and a second opening. In some embodiments, the front panel includes an elongated slot.

In some embodiments, the present system can be employed with a method for assembling the components of the housing. In some embodiments, the top panel and the bottom panel join a front panel and a back panel to enclose the interior cavity of the housing. In some embodiments, the top panel, the bottom panel, the front panel, and the back panel join the side panels to enclose the interior cavity of the housing. In some embodiments, a screw is inserted into a hole on the top panel to fix an eye loop which fixes an elastic band to the top panel.

In some embodiments, the present system comprises an amplification device that includes a housing having at least one reverb member. In some embodiments, the reverb member includes at least one spring disposed within the housing. In some embodiments, the reverb member includes at least one coil spring disposed within the housing to create a reverb effect. In some embodiments, the reverb member comprising at least one spring fixed to an inner surface of the housing. In some embodiments, the reverb member provides a reverb sound effect and amplifies the sound transmitted by the strings of the electric stringed instrument. In some embodiments, the reverb member receives sound waves from the strings of the electric stringed instrument and acoustically amplifies the sound. In some embodiments, the present system comprises an amplification device that attaches to the electric stringed instrument via a tension to maintain connection in multiple positions on the electric stringed instrument and is configured to improve sound transmittance. In some embodiments, the present system is configured to allow a user to hear the electric instrument better while playing the instrument unplugged.

In some embodiments, the housing includes a first panel and a second panel; each panel including an outer surface that defines at least one opening configured for engagement with a fastener. In some embodiments, the fastener connects the at least one reverb member with the housing. In some embodiments, the fastener includes one or more clevis pins that connect the at least one reverb member with the housing. In some embodiments, the front panel includes an outer surface that defines a plurality of spaced apart openings. In some embodiments, the plurality of spaced apart openings includes a first opening and a second opening. In some embodiments, the front panel includes an elongated slot. In some embodiments, the reverb member comprises a first spring and a second spring.

In some embodiments, the present system can be employed with a method for assembling the components of the housing. In some embodiments, a hole is drilled into a top panel of the housing. In some embodiments, a first hole and a second hole are drilled into side panels of the housing. In some embodiments, a first clevis pin is inserted into the first hole and a second clevis pin is inserted into the second hole. In some embodiments, a top panel and a bottom panel join the front panel and the back panel. In some embodiments, a first spring is attached to the first clevis pin on the first side panel and the second clevis pin on the second side panel. In some embodiments, a second spring is attached to the second clevis pin on the first side panel and the second clevis pin on the second side panel. In some embodiments, the top panel, bottom panel, front panel, and back panel join the side panels. In some embodiments, a screw is inserted into a hole on the top panel to fix an eye loop that fixes an elastic band to the top panel.

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure. In some embodiments, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of an acoustic amplification system, related components and methods of employing the amplification system in accordance with the principles of the present disclosure. Alternate embodiments are also disclosed. Reference is made in detail to the exemplary embodiments of the present disclosure, which are illustrated in the accompanying figures. Turning to FIGS. 1-5, there are illustrated components of an acoustic amplification system 20.

The components of system 20 can be fabricated from materials suitable for acoustic amplifier systems, including woods, metals, synthetic polymers, ceramics, and/or their composites. For example, the components of system 20, individually or collectively, can be fabricated from materials such as various woods including tone wood, redwood, Western red cedar, yellow cedar, Englemann spruce, white spruce, red spruce, sitka spruce, Indian rosewood, African mahogany, ebony, Honduras mahogany, Brazilian rosewood, bigleaf maple, and/or black walnut, stainless steel alloys, titanium alloys, cobalt-chrome alloys, thermoplastics, polyethylene terephthalate (PET), fabric, silicone, polyurethane, silicone-polyurethane copolymers, polymeric rubbers, polyolefin rubbers, semi-rigid and rigid materials, elastomers, thermoplastic elastomers, thermoset elastomers, elastomeric composites, rigid polymers including polyphenylene, polyamide, polyimide, polyetherimide, polyethylene, epoxy, and their combinations.

Various components of system 20 may have material composites, including the above materials, to achieve various desired characteristics such as acoustic amplification, strength and durability. The components of system 20, individually or collectively, may also be fabricated from a heterogeneous material such as a combination of two or more of the above-described materials. The components of system 20 may be monolithically formed, integrally connected or include fastening elements and/or instruments, as described herein.

System 20 includes a housing, such as, for example, a sound box 22 that defines a longitudinal axis L1. Sound box 22 is configured for engagement with a headstock 24 of an electric stringed instrument, such as, for example, an electric guitar 26 that emits sound. Sound box 22 increases strength and/or intensity, makes louder, larger and/or greater, enlarges, extends and/or expands, a signal, vibration and/or sound of electric guitar 26 acoustically by enhancing transmission of vibration of strings 46 of electric guitar 26 without electronic amplification. In some embodiments, strings 46 generate sound waves and/or vibrate at one or a plurality of frequencies and/or create one or a plurality of harmonics at various frequencies. In some embodiments, sound box 22 amplifies the sound non-electrically.

In some embodiments, sound box 22 is connected with headstock 24 in a plurality of alternate relative orientations. In some embodiments, sound box 22 is connected with headstock 24 at alternate relative orientations, such as, for example, transverse, perpendicular and/or other angular orientations such as acute or obtuse. In some embodiments, sound box 22 is removable and/or detachable from headstock 24. In some embodiments, sound box 22 is portable and removably attachable with headstock 24 such that sound box 22 comprises a portable amplification system to practice playing electric guitar 26. In some embodiments, sound box 22 is employed with electric guitar 26 for performance, demonstration, instruction and/or practice without the need for electrical amplifiers, wires, or electric power.

Sound box 22 has a rectangular configuration. In some embodiments, sound box 22 may have various configurations, such as, for example, oval, round, cylindrical, oblong, triangular, rectangular, polygonal having planar or arcuate side portions, irregular, uniform, non-uniform, consistent, variable, horseshoe shape, U-shape or kidney bean shape.

Sound box 22 includes a plurality of panels, including a top panel 28. Top panel 28 includes an outer surface that defines an opening 30. In some embodiments, opening 30 is centrally located on panel 28. Opening 30 is configured for engagement with a tension member and a fastener, as described below.

Sound box 22 includes a bottom panel 32. Bottom panel 32 is in a parallel configuration with top panel 28. In some embodiments, bottom panel 32 and top panel 28 are of the same size and dimension. In some embodiments, bottom panel 32 and top panel 28 are alternately sized and/or configured such that sound box 22 has a tapered configuration. Sound box 22 includes a side panel 34 and a side panel 36. Side panel 34 is in a parallel configuration with side panel 36. In some embodiments, side panel 34 and side panel 36 are of the same size and dimension. In some embodiments, side panel 34 and side panel 36 are alternately sized and/or configured such that sound box 22 has a tapered configuration.

Figure 2:
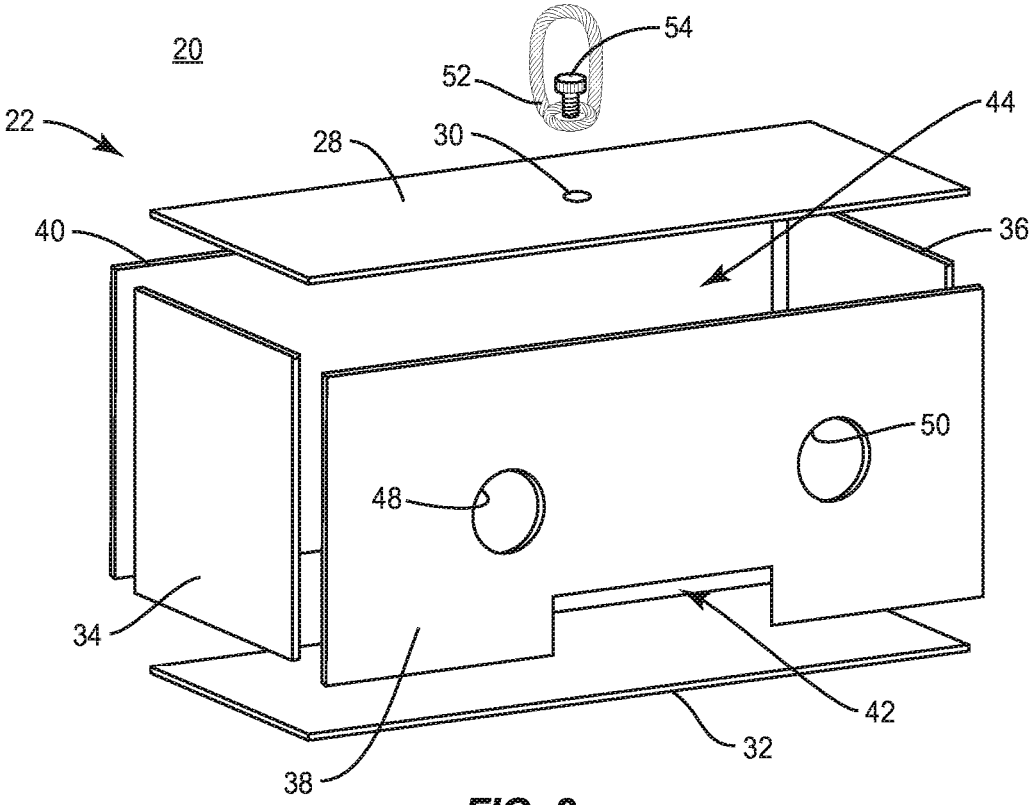
FIG. 2 is a perspective view of the components shown in FIG. 1 with parts separated.
Figure 3:
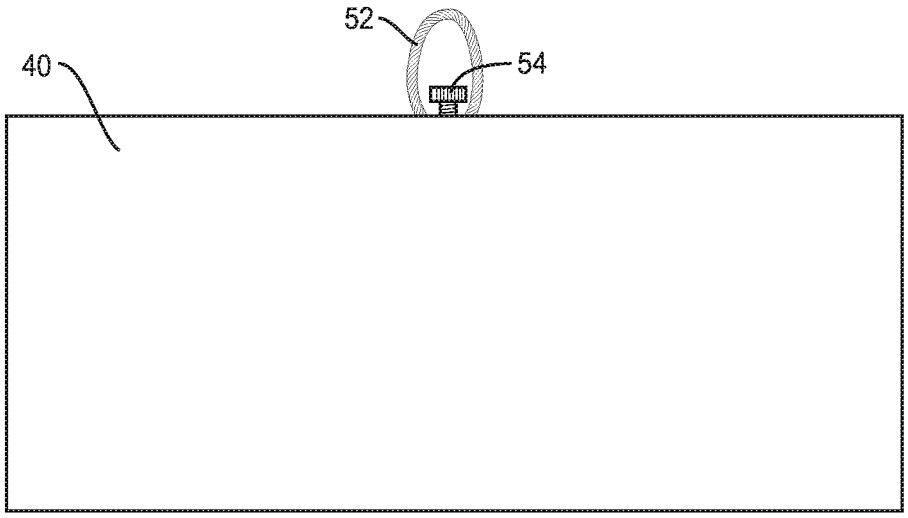
FIG. 3 is a side view of components of the system shown in FIG. 1.
Figure 4:
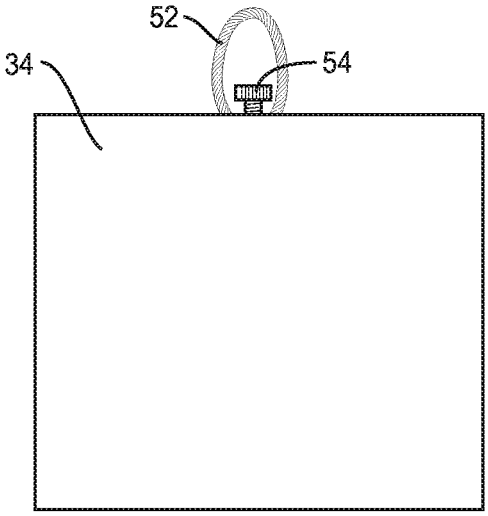
FIG. 4 is a side view of components of the system shown in FIG. 1.

Sound box 22 includes a front panel 38 and a back panel 40. Front panel 38 is in a parallel configuration with back panel 40. In some embodiments, front panel 38 and back panel 40 are of the same size and dimension. In some embodiments, front panel 38 and back panel 40 are alternately sized and/or configured such that sound box 22 has a tapered configuration. In some embodiments, side panel 34 is adjacent to top panel 28, bottom panel 32, front panel 38 and back panel 40. In some embodiments, side panel 36 is adjacent to top panel 28, bottom panel 32, front panel 38 and back panel 40. Panels 28, 32, 34, 36, 38, 40 are joined, as shown in FIG. 2, to form sound box 22, as shown in FIG. 1. In some embodiments, panels 28, 32, 34, 36, 38, 40 are joined to form sound box 22 via adhesive, fasteners, clips, hinges and/or mating elements, such as, for example, key/keyslot, dovetail connection or links. In some embodiments, panels 28, 32, 34, 36, 38, 40 are monolithically formed and/or molded including injection molded to form sound box 22.

In some embodiments, front panel 38 is a sound board. In some embodiments, front panel 38 is configured to receive sound waves from strings 46 of electric guitar 26, which resonate through sound box 22 and/or front panel 38 to increase strength and/or intensity, make louder, larger and/or greater, enlarge, extend and/or expand, signal, vibration and/or sound of strings 46. In some embodiments, sound box 22 includes a plurality of sound boards and/or one or more of panels 28, 32, 34, 36, 38, 40 can comprise a sound board.

Front panel 38 includes an outer surface that defines an elongated slot 42. Elongated slot 42 is in communication with a cavity 44 defined by an inner surface of sound box 22. Headstock 24 is configured for disposal within elongated slot 42 and cavity 44 to facilitate removable assembly of guitar 26 with sound box 22 for acoustic amplification of sound.

The outer surface of front panel 38 defines a plurality of spaced apart openings comprising a sound hole 48 and a sound hole 50. In some embodiments, hole 48 and hole 50 are round. In some embodiments, hole 48 and hole 50 are variously configured such as, for example, oval, oblong, triangular, polygonal, U-shape or kidney bean shape. In some embodiments, one or more of panels 28, 32, 34, 36, 38, 40 may include one or a plurality of sound holes.

System 20 includes a tension member, such as, for example, a band 52 configured to engage and extend from sound box 22. Band 52 extends from sound box 22 and is engageable with headstock 24. In some embodiments, sound box 22 may be permanently fixed with headstock 24, for example, via band 52. In some embodiments, sound box 22 may be removably attached, provisionally fixed and/or permanently fixed with headstock 24 via clips, extensions, flexible wire, straps, tether and/or adhesive.

Band 52 facilitates removable attachment of sound box 22 with headstock 24. Band 52 has a flexible configuration and may be fabricated from materials, such as, for example, fabric, silicone, polyurethane, silicone-polyurethane copolymers, polymeric rubbers, polyolefin rubbers, elastomers, rubbers, thermoplastic elastomers, thermoset elastomers and elastomeric composites. In some embodiments, the flexibility of band 52 includes movement in a lateral or side to side direction and prevents expanding and/or extension in an axial direction upon tensioning and attachment with headstock 24. In some embodiments, all or only a portion of band 52 may have a semi-rigid, rigid or elastic configuration, and/or have elastic properties, similar to the material examples described above, such that band 52 provides a selective amount of expansion and/or extension in an axial direction. In some embodiments, band 52 may be compressible in an axial direction. Band 52 can include a plurality of separately attachable or connectable portions or sections, such as bands or loops, or may be monolithically formed as a single continuous element.

Band 52 can have a uniform thickness/diameter. In some embodiments, the thickness defined by band 52 may be uniformly increasing or decreasing, or have alternate diameter dimensions along its length. In some embodiments, band 52 may have various cross section configurations, such as, for example, oval, oblong, triangular, rectangular, square, polygonal, irregular, uniform, non-uniform, variable and/or tapered. In some embodiments, the surface of band 52 may include engaging structures, such as, for example, barbs, raised elements and/or spikes to facilitate engagement with headstock 24.

In some embodiments, band 52 may have various lengths. In some embodiments, band 52 may be braided, such as a rope, or include a plurality elongated elements to provide a predetermined force resistance.

Band 52 fixedly engages sound box 22 via opening 30 and a fastening member, such as, for example, a screw 54. Screw 54 penetrates an end of band 52 and is inserted into opening 30. In alternative embodiments, band 52 engages sound box 22 via a staple, clips, friction fit, pressure fit, interlocking engagement, mating engagement, dovetail connection, hook and loop closure, barbs, tongue in groove, threaded, magnetic, key/keyslot, and/or adhesive.

Figure 5:
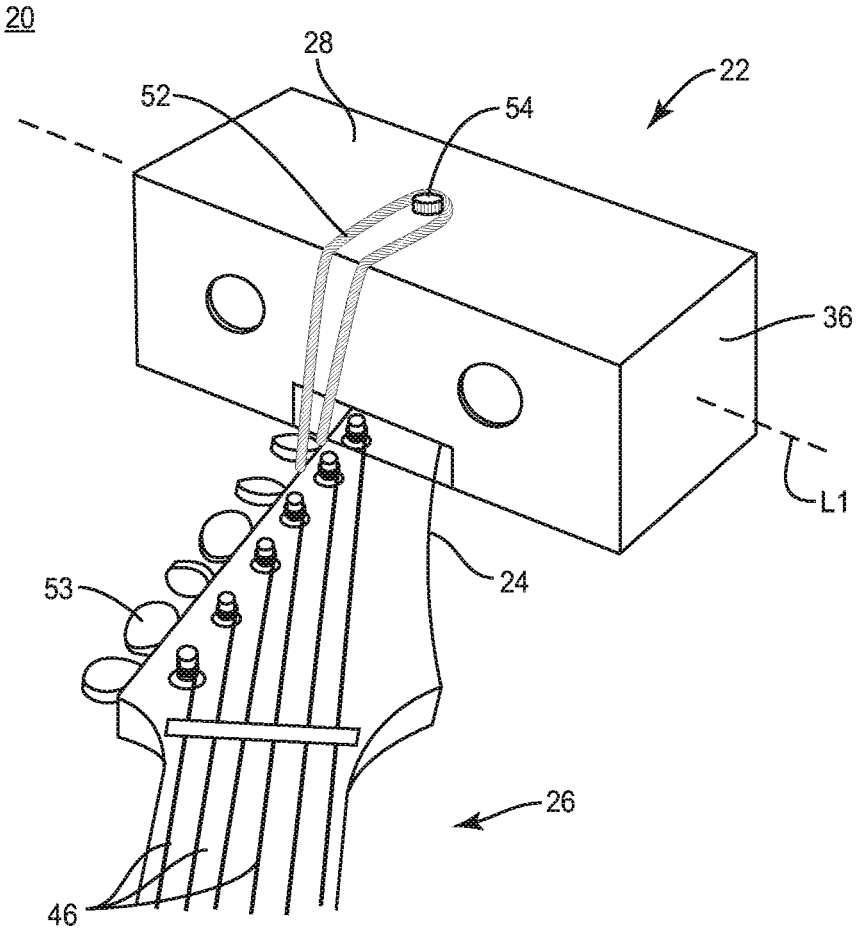
FIG. 5 is a perspective view of components of one embodiment of a system in accordance with the principles of the present disclosure disposed with an electric stringed instrument.

In operation, as shown in FIG. 5, a portion of headstock 24 of electric guitar 26 is passed through elongated slot 42 for disposal within cavity 44. Band 52 is manipulated and fixed to a portion of headstock 24, for example, by connecting or wrapping band 52 about one or more tuning keys 53 of headstock 24. In some embodiments, band 52 may be connected directly to headstock 24. As such, sound box 22 is removably attached via tension with electric guitar 26. A user manually strikes strings 46, and sound box 22 acoustically amplifies the sound emitted from the vibrations of strings 46, as described herein. Sound box 22 increases strength and/or intensity, make louder, larger and/or greater, enlarge, extend and/or expand, a signal, vibration and/or sound of electric guitar 26 acoustically by enhancing transmission of vibration of strings 46 without electronic amplification. To remove sound box 22 from headstock 24, band 52 is removed from keys 53 of headstock 24. Headstock 24 is withdrawn and removed from slot 42 to detach sound box 22 from electric guitar 26.

In one embodiment, as shown in FIGS. 6-9, system 20, similar to the systems and methods described with regard to FIGS. 1-5, includes a housing, such as, for example, a sound box 122, similar to sound box 22 described herein, which defines a longitudinal axis L2. Sound box 122 is configured for engagement with a headstock of an electric stringed instrument (not shown), similar to electric guitar 26 described herein, which emits sound. Sound box 122 increases strength and/or intensity, makes louder, larger and/or greater, enlarges, extends and/or expands, a signal, vibration and/or sound of the electric stringed instrument acoustically by enhancing transmission of vibration of strings of the electric stringed instrument without electronic amplification. In some embodiments, the strings of the electric stringed instrument generate sound waves and/or vibrate at one or a plurality of frequencies and/or create one or a plurality of harmonics at various frequencies. In some embodiments, sound box 122 amplifies the sound non-electrically.

Sound box 122 is removable and/or detachable from the headstock of the electric stringed instrument, similar to that described herein. Sound box 122 is portable and removably attachable with the headstock such that sound box 122 comprises a portable amplification system to practice playing the electric stringed instrument. In some embodiments, sound box 122 is employed with the electric stringed instrument for performance, demonstration, instruction and/or practice without the need for electrical amplifiers, wires, or electric power.

Sound box 122 has a rectangular configuration. Sound box 122 includes a plurality of panels, including a top panel 128. Top panel 128 includes an outer surface that defines an opening 130. In some embodiments, opening 130 is centrally located on panel 128. Opening 130 is configured for engagement with a tension member and a fastener, as described below.

Sound box 122 includes a bottom panel 132. Bottom panel 132 is in a parallel configuration with top panel 128. In some embodiments, bottom panel 132 and top panel 128 are of the same size and dimension. In some embodiments, bottom panel 132 and top panel 128 are alternately sized and/or configured such that sound box 122 has a tapered configuration. Sound box 122 includes a side panel 134 and a side panel 136. Side panel 134 is in a parallel configuration with side panel 136. In some embodiments, side panel 134 and side panel 136 are of the same size and dimension. In some embodiments, side panel 134 and side panel 136 are alternately sized and/or configured such that sound box 122 has a tapered configuration.

Side panel 134 includes an outer surface that defines a plurality of openings, including an opening 156 and an opening 158. Opening 156 is configured for engagement with a fastener, such as a U-shaped clevis fastener 160, and opening 158 is configured for engagement with a fastener, such as a U-shaped clevis fastener 162. Clevis fasteners 160, 162 are each configured for engagement with an end of a mechanical reverb member for connecting the reverb member to sound box 122. Clevis fasteners 160, 162 each engage a reverb member such that the reverb member and/or a connection element of the clevis fastener to the reverb member is movable relative to panel 134, as described below.

Side panel 136 includes an outer surface that defines a plurality of openings, including an opening 164 and an opening 166. Opening 164 is configured for engagement with a fastener, such as a U-shaped clevis fastener 168, and opening 166 is configured for engagement with a fastener, such as a U-shaped clevis fastener 170. Clevis fasteners 168, 170 are each configured for engagement with an end of a mechanical reverb member for connecting the reverb member to sound box 122. Clevis fasteners 168, 170 each engage a reverb member such that the reverb member and/or a connection element of the clevis fastener to the reverb member is movable relative to panel 136, as described below. In some embodiments, one or more reverb members may be connected to one or more panels of sound box 122 via various connecting elements, such as, for example, pins, bolts, screws, hinges, living hinge, nails, posts, clips and/or adhesive.

System 20 includes a mechanical reverb member 172 that includes a coil spring 174 and a coil spring 176. Reverb member 172 is configured to facilitate a reverb-type sound effect in connection with playing of the electric stringed instrument. Reverb member 172 receives sound waves from the strings of the electric stringed instrument and acoustically amplifies the sound. In some embodiments, reverb member 172 can include one or a plurality of springs. In some embodiments, reverb member 172 can alternatively include one or a plurality of flexible members, leaf springs, bands, wires and/or bars.

Coil spring 174 includes an end 178 that engages clevis fastener 160 such that coil spring 174 is connected with panel 134 and movable relative thereto. In some embodiments, end 178 is pivotable and/or rotatable relative to panel 134. In some embodiments, end 178 is movable relative to panel 134 to facilitate vibration of coil spring 174 in connection with playing of the electric stringed instrument, as described herein.

Coil spring 174 includes an end 180 that engages clevis fastener 168 such that coil spring 174 is connected with panel 136 and movable relative thereto. In some embodiments, end 180 is pivotable and/or rotatable relative to panel 136. In some embodiments, end 180 is movable relative to panel 136 to facilitate vibration of coil spring 174 in connection with playing of the electric stringed instrument, as described herein.

Coil spring 176 includes an end 182 that engages clevis fastener 162 such that coil spring 176 is connected with panel 134 and movable relative thereto. In some embodiments, end 182 is pivotable and/or rotatable relative to panel 134. In some embodiments, end 182 is movable relative to panel 134 to facilitate vibration of coil spring 176 in connection with playing of the electric stringed instrument, as described herein.

Coil spring 176 includes an end 184 that engages clevis fastener 170 such that coil spring 176 is connected with panel 136 and movable relative thereto. In some embodiments, end 184 is pivotable and/or rotatable relative to panel 136. In some embodiments, end 184 is movable relative to panel 136 to facilitate vibration of coil spring 176 in connection with playing of the electric stringed instrument, as described herein.

Figure 6:
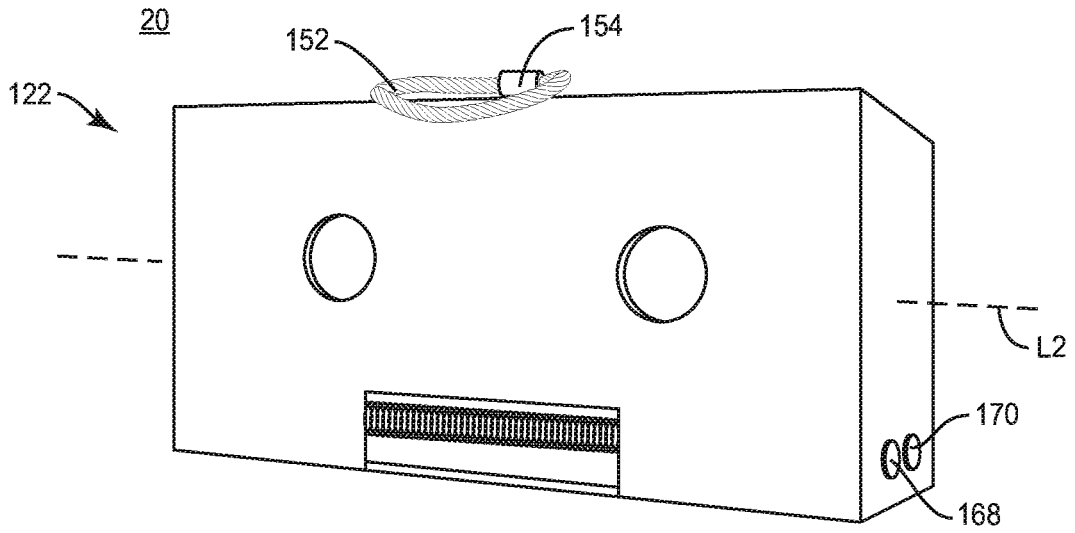
FIG. 6 is a perspective view of components of one embodiment of an amplification system in accordance with the principles of the present disclosure.
Figure 7:
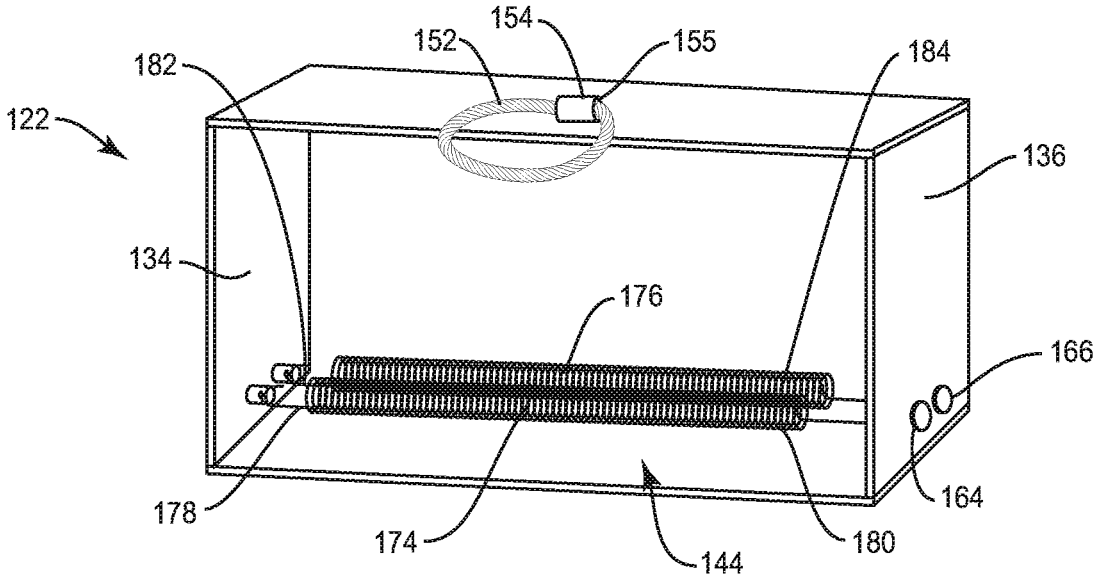
FIG. 7 is a cutaway perspective view of components of the system shown in FIG. 6.
Figure 8:
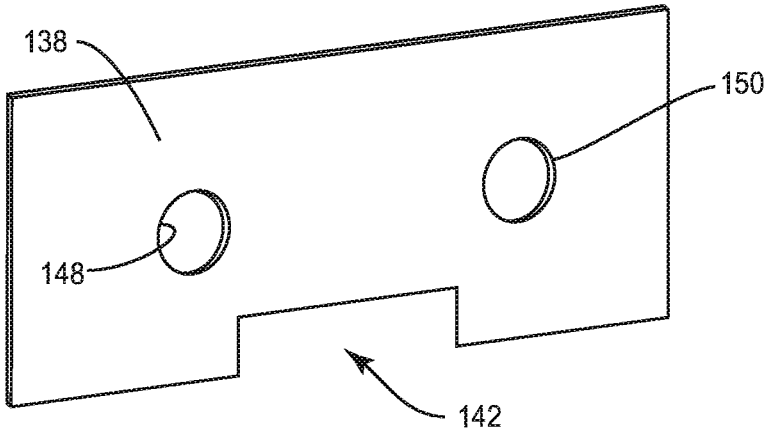
FIG. 8 is a perspective view of components of the system shown in FIG. 6.
Figure 9:
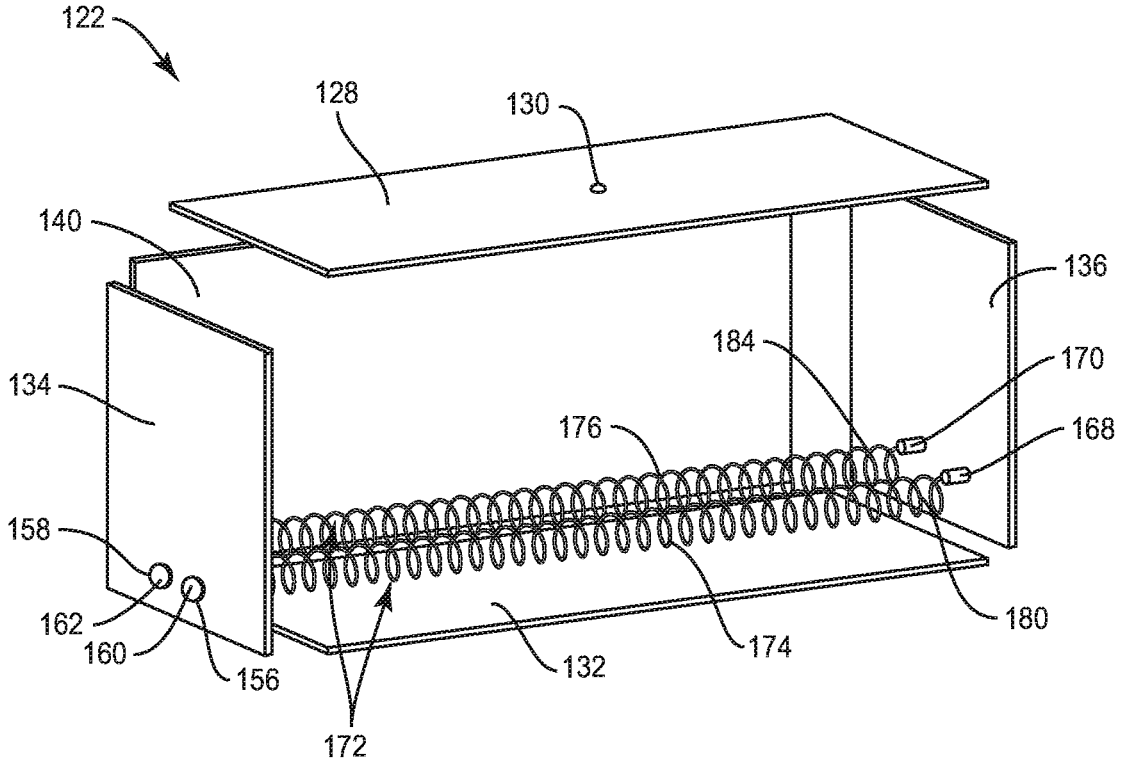
FIG. 9 is a perspective view of components of the system shown in FIG. 6 with parts separated.

Sound box 122 includes a front panel 138 and a back panel 140. Front panel 138 is in a parallel configuration with back panel 140. In some embodiments, front panel 138 and back panel 140 are of the same size and dimension. In some embodiments, front panel 138 and back panel 140 are alternately sized and/or configured such that sound box 122 has a tapered configuration. In some embodiments, side panel 134 is adjacent to top panel 128, bottom panel 132, front panel 138 and back panel 140. In some embodiments, side panel 136 is adjacent to top panel 128, bottom panel 132, front panel 138 and back panel 140. Panels 128, 132, 134, 136, 138, 140 are joined, as shown in FIGS. 8 and 9, to form sound box 122, as shown in FIG. 6. In some embodiments, panels 128, 132, 134, 136, 138, 140 are joined to form sound box 122 via adhesive, fasteners, clips, hinges and/or mating elements, such as, for example, key/keyslot, dovetail connection or links. In some embodiments, panels 128, 132, 134, 136, 138, 140 are monolithically formed and/or molded including injection molded to form sound box 122.

In some embodiments, front panel 138 is a sound board. In some embodiments, front panel 138 is configured to receive sound waves from strings of the electric stringed instrument, which resonate through sound box 122 and/or front panel 138 to increase strength and/or intensity, make louder, larger and/or greater, enlarge, extend and/or expand, signal, vibration and/or sound of the strings. In some embodiments, sound box 122 includes a plurality of sound boards and/or one or more of panels 128, 132, 134, 136, 138, 140 can comprise a sound board.

Front panel 138 includes an outer surface that defines an elongated slot 142. Elongated slot 142 is in communication with a cavity 144 defined by an inner surface of sound box 122. The headstock of the electric stringed instrument is configured for disposal within elongated slot 142 and cavity 144 to facilitate removable assembly of the electric stringed instrument with sound box 122 for acoustic amplification of sound and to provide a reverb-type sound effect.

The outer surface of front panel 138 defines a plurality of spaced apart openings comprising a sound hole 148 and a sound hole 150. In some embodiments, hole 148 and hole 150 are round. In some embodiments, hole 148 and hole 150 are variously configured such as, for example, oval, oblong, triangular, polygonal, U-shape or kidney bean shape. In some embodiments, one or more of panels 128, 132, 134, 136, 138, 140 may include one or a plurality of sound holes.

System 20 includes a tension member, such as, for example, a band 152, similar to band 52 described herein, configured to engage and extend from sound box 122. Band 152 extends from sound box 122 and is engageable with the headstock of the electric stringed instrument. In some embodiments, sound box 122 may be permanently fixed with the headstock of the electric stringed instrument, for example, via band 152. In some embodiments, sound box 122 may be removably attached, provisionally fixed and/or permanently fixed with the headstock of the electric stringed instrument via clips, extensions, flexible wire, straps, tether and/or adhesive. Band 152 facilitates removable attachment of sound box 122 with the headstock of the electric stringed instrument.

Band 152 fixedly engages sound box 122 via opening 130 and a fastening member, such as, for example, an eye loop 154. Eye loop 154 includes a channel 155 that is configured for disposal of a portion of band 152. In some embodiments, eye loop 154 is plastic. In alternative embodiments, band 152 engages sound box 122 via a staple, clips, friction fit, pressure fit, interlocking engagement, mating engagement, dovetail connection, hook and loop closure, barbs, tongue in groove, threaded, magnetic, key/keyslot, and/or adhesive.

In operation, a portion of the headstock of the electric stringed instrument is passed through elongated slot 142 for disposal within cavity 144. Band 152 is manipulated and fixed to a portion of the headstock, for example, by connecting or wrapping band 152 about one or more tuning keys (not shown) of the headstock of the electric stringed instrument. As such, sound box 122 is removably attached via tension with the electric stringed instrument. A user manually strikes the strings of the electric stringed instrument, and sound box 122 acoustically amplifies the sound emitted from the vibrations of the strings, as described herein. Coil springs 174, 176 vibrate due to the vibration of the strings to provide a reverb-type sound effect, as described herein. Sound box 122 and reverb member 172 increase strength and/or intensity, make louder, larger and/or greater, enlarge, extend and/or expand, a signal, vibration and/or sound of the electric stringed instrument acoustically by enhancing transmission of vibration of the strings without electronic amplification. To remove sound box 122 from the headstock of the electric stringed instrument, band 152 is removed from the keys of the headstock. The headstock of the electric stringed instrument is withdrawn and removed from slot 142 to detach sound box 122 from the electric stringed instrument.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

The invention claimed is:

1. An electric stringed instrument amplifier comprising:

a housing including an inner surface that defines a cavity configured for disposal of at least a portion of a headstock of an electric stringed instrument, the electric stringed instrument being configured to emit sound; and a tension member extending from the housing and engageable with the headstock.

2. An electric stringed instrument amplifier as recited in claim 1, wherein the housing amplifies the sound acoustically.

3. An electric stringed instrument amplifier as recited in claim 1, wherein the housing amplifies the sound non-electronically.

4. An electric stringed instrument amplifier as recited in claim 1, wherein the housing includes at least one reverb member.

5. An electric stringed instrument amplifier as recited in claim 1, wherein the housing includes at least one mechanical reverb member.

6. An electric stringed instrument amplifier as recited in claim 1, wherein the housing includes at least one coil spring.

7. An electric stringed instrument amplifier as recited in claim 1, wherein the housing includes a first coil spring and a second coil spring, the springs being disposed in a relative parallel orientation within the cavity.

8. An electric stringed instrument amplifier as recited in claim 1, wherein the housing is removable from the headstock.

9. An electric stringed instrument amplifier as recited in claim 1, wherein the tension member includes an elastic band.

10. An electric stringed instrument amplifier as recited in claim 1, wherein the housing comprises a plurality of panels.

11. An electric stringed instrument amplifier as recited in claim 1, wherein the housing comprises a rectangular configuration.

12. An electric stringed instrument amplifier as recited in claim 1, wherein the housing defines an elongated slot in communication with the cavity and configured for disposal of the headstock.

13. An electric stringed instrument amplifier as recited in claim 1, wherein the housing defines a plurality of spaced apart openings.

14. An electric stringed instrument amplifier as recited in claim 1, wherein the electric stringed instrument includes a plurality of strings that vibrate to emit the sound.

15. An electric stringed instrument amplifier comprising:

a housing including a plurality of connected planar panels, the panels defining a cavity configured for disposal of at least a portion of a headstock of an electric stringed instrument having a plurality of strings that vibrate to emit sound, at least one of the panels defining a plurality of spaced apart openings; and an elastic band extending from the housing and engageable with the headstock such that the housing amplifies the sound acoustically.

16. An electric stringed instrument amplifier comprising:

a housing including an inner surface that defines a cavity configured for disposal of at least a portion of a headstock of an electric stringed instrument, the electric stringed instrument being configured to emit sound, the housing further including at least one mechanical reverb member; and a tension member extending from the housing and engageable with the headstock.

17. An electric stringed instrument amplifier as recited in claim 16, wherein the reverb member includes at least one coil spring.

18. An electric stringed instrument amplifier as recited in claim 16, wherein the reverb member includes a first coil spring and a second coil spring, the springs being disposed in a relative parallel orientation within the cavity.

19. An electric stringed instrument amplifier as recited in claim 16, wherein the housing is removable from the headstock.

20. An electric stringed instrument amplifier as recited in claim 16, wherein the housing amplifies the sound acoustically.

21. An electric stringed instrument amplifier as recited in claim 1, wherein the housing is connectable with the headstock in a plurality of alternative relative orientations.

* * * * *